US007847692B2

(12) United States Patent
Schuller

(10) Patent No.: US 7,847,692 B2
(45) Date of Patent: Dec. 7, 2010

(54) ANTI-THIEF DEVICE

(76) Inventor: Carmen Schuller, 115 E. 61st St., New York, NY (US) 10022

( * ) Notice: Subject to any disclaimer, the term of this patent is extended or adjusted under 35 U.S.C. 154(b) by 414 days.

(21) Appl. No.: 11/925,625

(22) Filed: Oct. 26, 2007

(65) Prior Publication Data

US 2009/0109027 A1 Apr. 30, 2009

(51) Int. Cl.

| | |
|---|---|
| ***G08B 13/14*** | (2006.01) |
| ***A47B 91/00*** | (2006.01) |
| ***A47G 29/00*** | (2006.01) |
| ***B65D 19/00*** | (2006.01) |

(52) U.S. Cl. ..... 340/568.1; 248/551; 248/346.03

(58) Field of Classification Search ..... 340/568.1, 340/539.1, 539.11; 248/304–308, 309.1–316.8, 248/95, 99, 100, 551, 346.01, 346.03
See application file for complete search history.

(56) References Cited

U.S. PATENT DOCUMENTS

| | | | | |
|---|---|---|---|---|
| 5,594,419 | A | 1/1997 | Lo | |
| 5,889,475 | A * | 3/1999 | Klosinski et al. | 340/902 |
| 6,686,841 | B1 * | 2/2004 | Busch et al. | 340/571 |
| 6,935,911 | B1 * | 8/2005 | Stewart et al. | 441/81 |
| 7,385,521 | B2 * | 6/2008 | Macari | 340/686.6 |
| 7,464,911 | B1 * | 12/2008 | Yen | 248/304 |
| 7,619,519 | B2 * | 11/2009 | Richter | 340/568.8 |
| 2002/0109596 | A1 * | 8/2002 | Phillips et al. | 340/573.1 |

* cited by examiner

*Primary Examiner*—Jennifer Mehmood
(74) *Attorney, Agent, or Firm*—Leason Ellis LLP.

(57) ABSTRACT

A personal article anti-theft system includes a base retained on a surface and a hook connected to the base so that it can hang downward. A detection circuit is located within the base and is connected to the hook so as to detect the presence of an item on the hook. If the item is removed from the hook without authorization, e.g., during a theft, an alarm circuit operatively connected to the detection circuit will sense the removal of an item. If the alarm circuit is in a set condition, the removal will generate an alarm signal. The resulting alarm signal is received at a remote alarm detection circuit located at a distance from the base. Receipt of this signal causes the remote alarm to produce a humanly perceivable indication of the alarm.

14 Claims, 3 Drawing Sheets

ANTI-THIEF DEVICE

BACKGROUND OF THE INVENTION

1. Field of the Invention

The present invention relates to apparatus for protecting valuable portable objects against theft.

2. Discussion of the Related Art

While at social events conducted at commercial establishments, particularly night clubs, it is common for people to leave their personal items on tables or wall hooks. This can typically occur while the person is using a restroom, dancing or chatting with people at other tables in the establishment. These items include purses, articles of clothing (e.g., sweaters and jackets), and small electronic devices (e.g., Ipods, Walkman, cell phones, etc.). Unscrupulous individuals survey such establishments for opportunities to steal these valuable articles when they are unattended. The resulting theft causes the establishment owner to have to deal with customer complaints that could harm the reputation of the club and the theft could create liability for the owner. Of course, the theft also results in the loss of the property to the owner, which may not only be monetarily valuable, but have sentimental value.

A solution to this problem has been proposed in U.S. Pat. No. 5,594,419 of Lo. In particular, the Lo patent discloses a table-edge hanger device that can be used to protect personal items, such as a purse or a jacket, against theft. The device has a square base that can be placed near the edge of a table. A hanger, on which valuable items can be hung, extends from the base over the edge of the table. Further, a micro-switch is located in the base and is arranged to so that it is operated if an item is placed on the hanger. In use the owner of a personal item hooks it on the hanger and if it is removed, the micro-switch senses the change and causes an alarm in the form of either a warning light or a sound, to be activated. A further switch in an inconspicuous place can be used to turn the device on and to turn it off, thus turning off the alarm.

Because of the public location, the alarm in a system such as that in the Lo patent is made to have a limited range, so as not to disturb others when there is a false alarm, e.g., when the rightful owners removes the item without turning off the device. Also, even when the alarm is made noticeable over a significant distance, there is no guarantee that the owner will be notified. For example the owner may be at a restroom on another floor. Those sitting near the device exhibiting the alarm may not have sufficient interest to actively stop the theft. Also, security officials of the establishment might not be aware of the activation of the alarm until it is too late to stop the theft. Still further, if the alarm is noticeable to the thief, the thief may make a hasty exit and escape capture.

Thus, it would be advantageous if a means were provided for immediately indicating to the owner of an item and/or security personnel of an ongoing theft. It would further be a benefit if the notification could be silent, so as not to disturb other patrons of the establishment and to aid in the apprehension of the thief.

SUMMARY OF THE INVENTION

The present invention is directed to an anti-theft system for protecting portable personal items attached to the system and remotely signaling their removal.

In an illustrative embodiment, the system has a base which may be secured in place on the edge of a table or a wall. It may be secured by its own weight, suction cups or fasteners of various kinds. A hook is operatively disposed to hand from the base so it can be used to hold the personal item, and so that the presence or absence of the item from the hook can be detected.

Once the device is activated and a valuable personal item is placed on the hook, the removal of the item without first deactivating the device will cause an alarm to be activated. The alarm may be a sound or flashing light on the base of the device. In addition to or as an alternative, the device alarm may generate a signal that may be received remotely by the owner of the item or security personnel of the establishment, which indicates that a theft is in progress. In a preferred embodiment, the signal is a radio frequency (rf) signal with a range of up to about 50-100 yards. This rf signal is received by a portable device on the person of the owner or a security guard, or at a security terminal. When designed to be carried by a person, the receiver is small enough to be conveniently carried in the owner's pocket. As an alternative, it may be in the form of a piece of jewelry, e.g., a broach, which can be conveniently worn by the owner of the item. Further, it is within the scope of the invention to incorporate the receiver into some other item normally worn by the owner, e.g., a watch or ring.

The use of a remote, and potentially silent alarm, improves the chances that a thief will be apprehended before making an escape.

DESCRIPTION OF THE DRAWING FIGURES

These and other features, aspects, and advantages of the present invention will become better understood with reference to the following description, appended claims and the accompanying drawings wherein:

DETAILED DESCRIPTION OF THE PRESENTLY PREFERRED EXEMPLARY EMBODIMENTS

Figure 1:
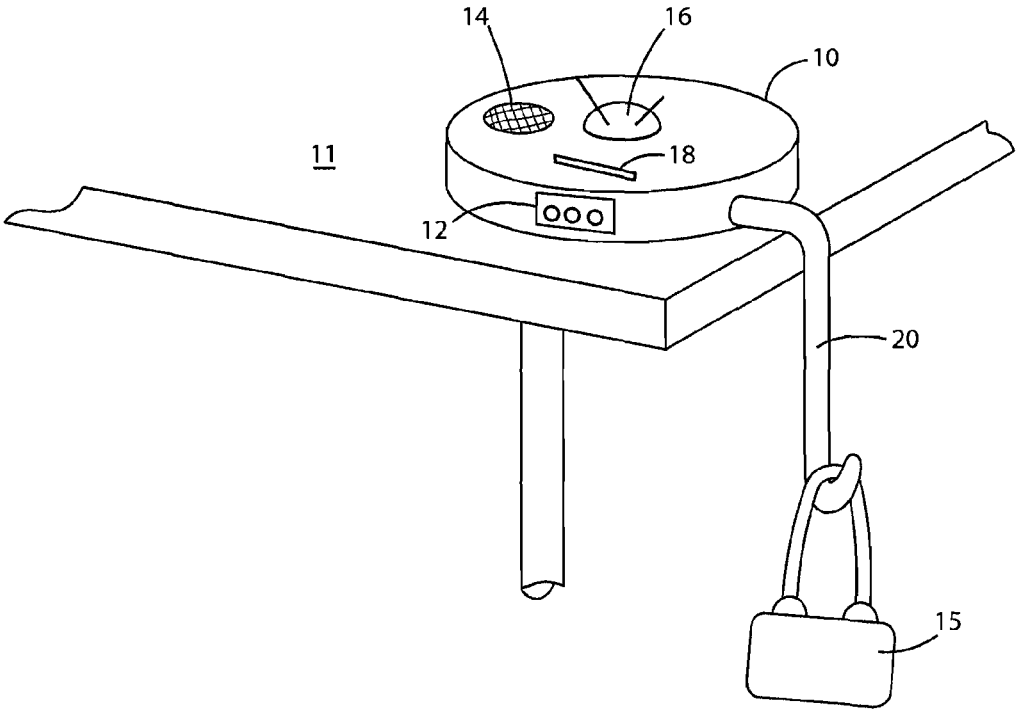
FIG. 1 is a perspective view of a device according to the present invention located on the edge of a table.
Figure 2:
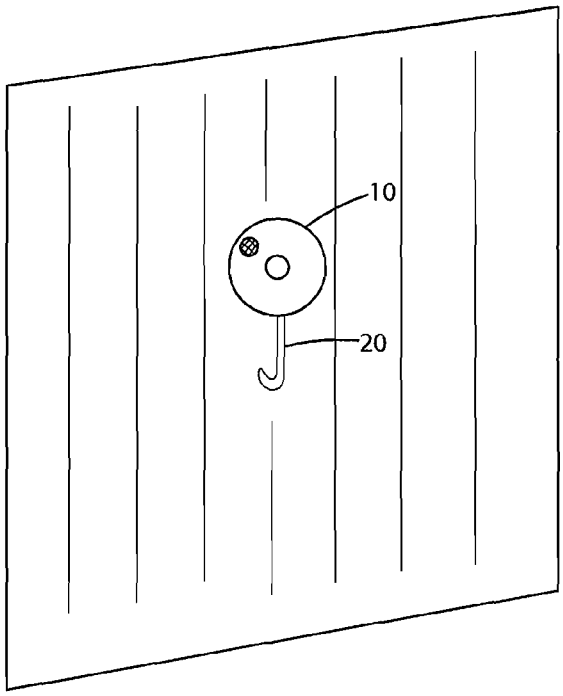
FIG. 2 is an illustration of a device according to the present invention located on a wall.

FIGS. 1 and 2 are illustrations of an anti-theft device according to the present invention. This device is used to prevent the theft of valuable articles that may otherwise be draped over a chair at a club or restaurant. The device has two main parts, i.e., a base 10 and a hook 20 that depends or hangs down from the base. In the arrangement of FIG. 1, the base 10 is placed on a table near its edge so that the hook 20 hangs over the edge. The article to be protected, e.g., purse 15, is hung on the hook. The article can be anything of value with at least some minimal amount of weight, e.g., a purse, a laptop in a case, an Ipod, clothing, etc.

The base 10 may be held in place on the table by its weight or by some fastening means, e.g., clamps, suction cups or Velcro, on the bottom of the base (not shown). In the embodiment of FIG. 2, the weight of the device is not used to hold it in place on the wall. However, other fastening devices, e.g., clamps, suction cups or fasteners (nails, screws, bolts, Velcro, etc.) may be used to hold it in place.

The device is turned on with a code that is entered through push buttons 12 located on a side wall of the base 10. When the article is hung on the hook, the weight of the article is detected by the base through the hook. Detection can be by means of the activation of a micro-switch, a strain gauge or some other device capable of detecting the presence of the article on the hook. A sensitive strain gauge is preferred when weight is to be detected, since it can be set to detect slight changes in weight on the hook, e.g., in the range of the weight of a sweater. If the weight sensitivity of the base is high, the unauthorized removal of even a light weight article, e.g., an expensive sweater, from the hook or the removal of some item from an article on the hook, e.g., a wallet from a purse, can be detected. Other means of detecting the article on the hook can include capacitive coupling, photo detectors, resistance measurements, etc.

Once the presence of the item on the hook is detected, e.g., by its weight, the device is in an alarm ready condition. If someone lifts the article from the hook without first deactivating the device by entering a code through the push buttons 12, the change is sensed in the base. This triggers an alarm circuit in the base, which can be used to produce a humanly perceivable signal notifying the owner or security personnel of the attempted theft.

The humanly perceivable alarm my be a sound emitted from a speaker 14, a light 16 or a combination of sound and light effects. This alarm is intended to scare the thief away, hopefully without the item, and to notify people in the vicinity of the attempted theft, much like a car alarm. The actual alarm can be in the base or in a remote unit that is connected to the base wirelessly or by wires. An antenna 18 is provided for wireless radio frequency communication with a remote unit. For example, the alarm could be at a security location (50 in FIG. 5) near the front door of the establishment.

While the device may be purchased by an owner of expensive portable personal property and carried to an establishment, it is also contemplated that devices of this type would be purchased by establishments and rented or loaned to patrons. The owner of the establishment or security personnel engaged by the establishment would know the code to activate and deactivate the device. The codes for activation and deactivation may be the same or different. Further, the codes for each device may be the same or different. If the device is distributed from a central location, for example at a coat check for the establishment, then if the alarm goes off, a signal can be sent wirelessly or by wire to security station 50 so that security personnel will be notified. If the security station is near the coat check or the front door, the security personnel will have a chance to apprehend the thief before he can leave the establishment. This opportunity to catch the thief is enhanced if the alarm, at least at the base, is undetectable. In particular, if there are no alarm sounds or flashing lights at the base where the item is being taken, the thief may not know that the theft has been detected. Thus, the thief may not even try to leave the premises, with the hope of stealing more items. Even if the thief does decide to leave, his departure may be at a leisurely pace which will facilitate his capture.

Figure 5:
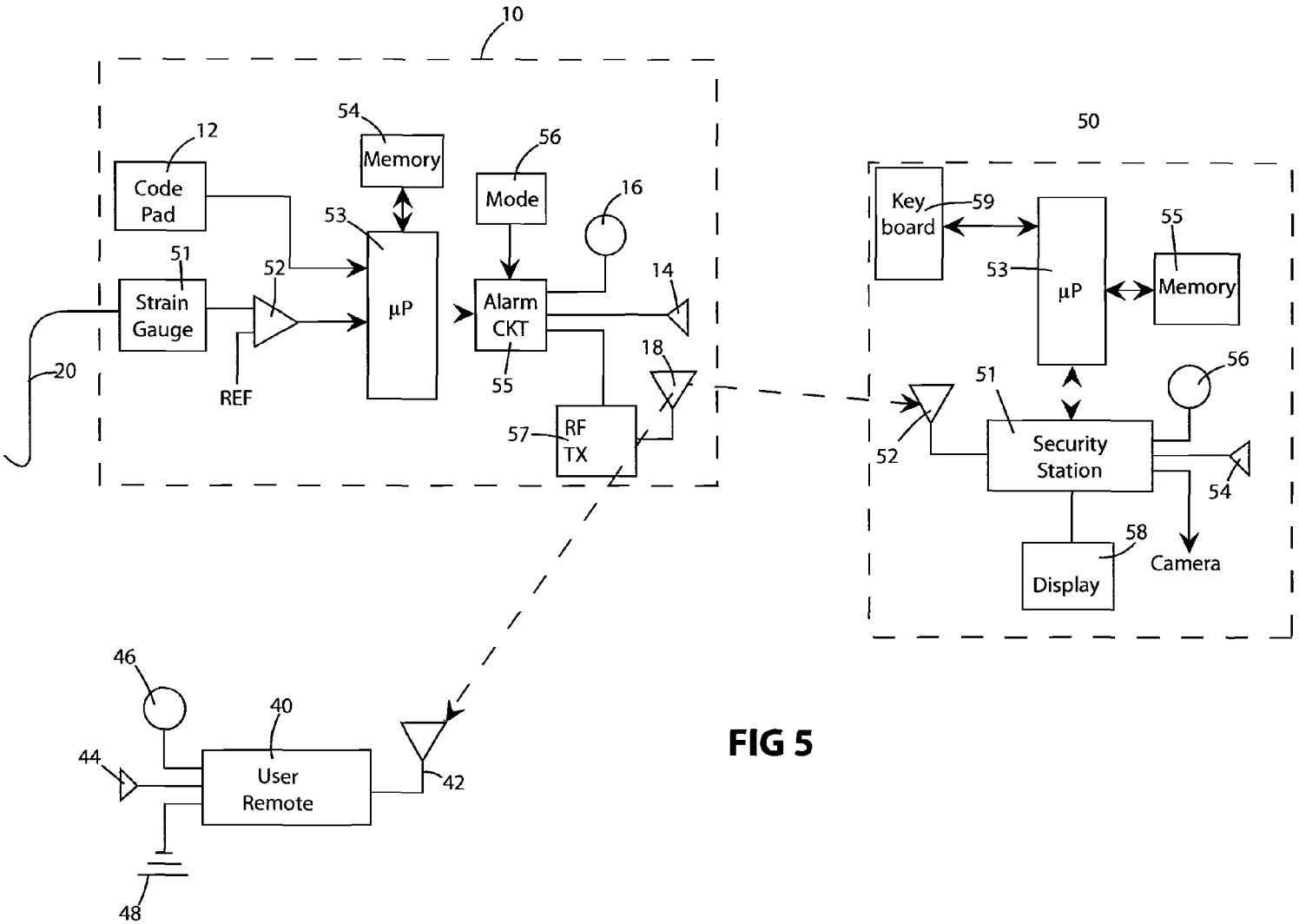
FIG. 5 is a block diagram of a circuit for the device, a remote detector and a computer operated security system for keeping track of multiple devices in an establishment.

Chances of apprehension may additionally be improved if, when the establishment gives out the device, a record is made of the location of the table or wall where it will be used and of a description of the item to be protected. In this way security personnel can move quickly to the location of the theft and can look for someone carrying the described item. If such a record is kept, perhaps in a computer system as shown in FIG. 5, the information may be rapidly and automatically displayed, thus further increasing the chances of apprehending the thief.

Figure 3:
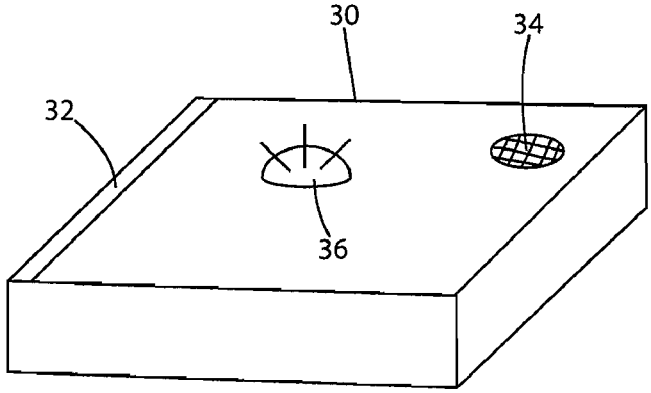
FIG. 3 is an illustration of a remote alarm signal receiver for a user's pocket.

An alarm signal from the base can be sent to a remote device wirelessly using radio frequency (rf) communications. Other wireless communication systems can also be used, e.g., infrared. If it is desired to remotely contact the owner of the item, they can be provided with a device 30 as shown in FIG. 3 which will receive the wireless alarm signal on its antenna 32 and indicate an alarm condition. This may be by way of a sound from a speaker 34 or lights 36. In addition, since the device 30 is designed to be carried in the user's pocket, it may be provided with a vibrator (not shown) to signal an alarm condition when the device is in a user's pocket and it is not visible or easily heard.

Figure 4:
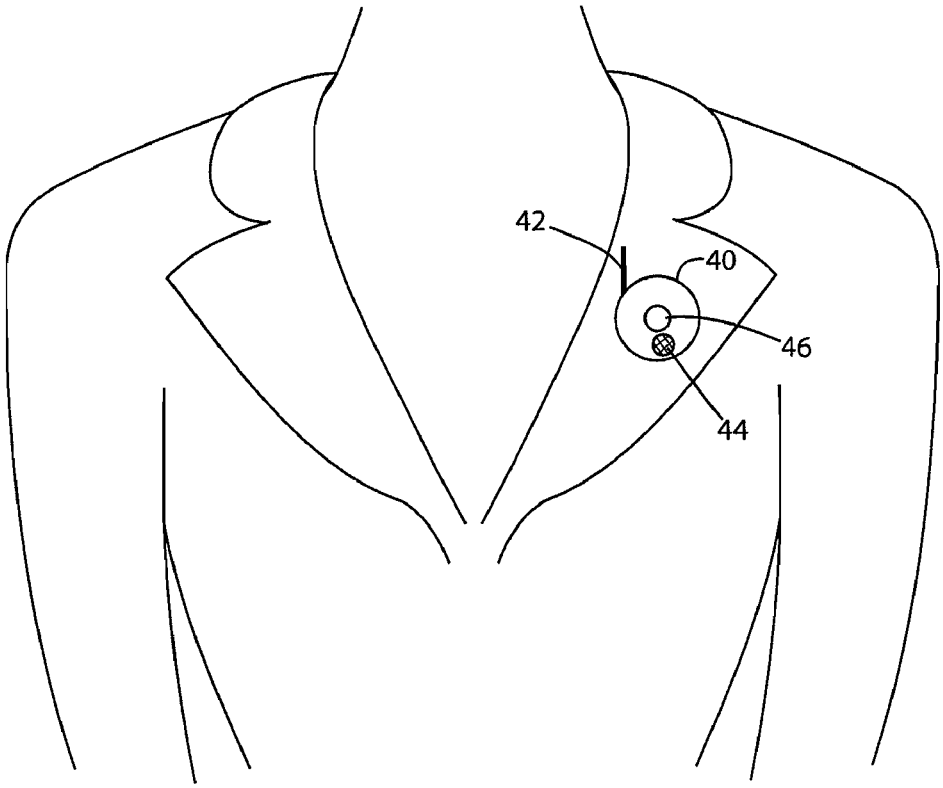
FIG. 4 is an illustration of a remote alarm signal receiver in the form of a broach.

As an alternative, the remote alarm device could be a piece of jewelry as shown in FIG. 4, which is worn by the user, e.g., a broach 40. This device may have an antenna 42 for receiving an r.f. alarm signal, a sound alarm 44, a light alarm 46 and/or a vibration alarm (not seen). Thus, even when the user is not in the vicinity of the article, the user is notified of the attempt to remove the article from the hook 20. This same alarm can simultaneously be sent to security personnel at terminal 50 so that they and the owner are notified simultaneously, as indicated schematically in FIG. 5.

When the lawful owner is ready to retrieves the article from the hook 20, the owner enters the proper code through buttons 12 on the base 10 to disarm the alarm. When the device is rented from an establishment, the owner will have to be provided with the codes by the establishment. This may be part of the coat check procedure for the establishment.

As noted above, the device can be permanently attached to tables or convenient walls of an establishment, e.g. by screw brackets. As an alternative, the establishment can rent or loan the devices to customers to be placed at their table. These devices could be made of heavy metal so that the device is portable, but the weight of the base is sufficient to keep the device in place, even when loaded with an article. In another embodiment, if the device is made light enough in weight and small enough so that it can be carried by a user to a table in an establishment and then irremovably connected to a table or wall, e.g., by clamps or Velcro. If the device is to be sold to individuals, it must also be made small and light enough for a user to carry it over extended distances, e.g., in the user's purse. In such a case, the base would be small, made of a light weight material such as plastic, and would be fastened to the table or wall by clamps or suction cups or Velcro. It should be noted that with light weight portable devices that are releasably coupled to a surface, any attempt to remove the entire device as a means of theft, would cause a sufficient change in the strain on the hook 20 so that an alarm would go off.

Turning now to FIG. 5, an exemplary circuit is shown for an embodiment of the present invention. As shown, the hook 20 is connected to a strain gauge 51 which produces an analog voltage signal output depending on the strain applied to hook 20. This output is compared to a reference level in a comparator 52, which produces a binary output whenever the strain exceeds a preset level depending on the reference. This signal, as well as signals from the code buttons 12 are provided to a microprocessor 53 operating a program stored in memory 54.

According to the program, the microprocessor 53 ignores the comparison signals until the code signals instruct it to set the alarm. Then the microprocessor looks for a signal from the comparator 52 that indicates a reduction in the strain on hook 20 due to removal of an item from the hook or the lifting of the entire base from the table. If this occurs before a subsequent code signal that tells the microprocessor 53 to disarm the alarm, it will trigger the generation of an alarm signal. The alarm signal is applied to an alarm circuit 55, which depending on the setting of it mode by mode circuit 56, will cause it to trigger lights 16, sound speaker 14 or both in some combination. As an alternative, the alarm may be locally silent, so that neither lights nor sound is produced locally. Instead the alarm circuit 55 triggers a remote warning circuit 57, which may drive a wired connection to a remote site. It may also trigger a wireless signal to a remote site, e.g., an r.f. transmission through antennal 18. This transmission may be delivered to a remote security terminal 50 and/or to some device on the user, e.g., broach 40.

If the wireless signal is received a broach 40, it is picked up by antennal 42 and used to trigger lights 46, speaker 44 and/or vibration generator 48, so that the use can see, hear and/or feel the alarm condition. If the user is away-from his table at the time, the signal will cause the user to quickly return to the take to see if a theft is in progress, or whether someone has accidentally displaced the item.

Since the owner may not be physically capable of apprehending a thief, the signal may be simultaneously transmitted to security terminal 50, which may be conveniently located to intercept a thief seeking to escape the premises. This signal is picked up by an antenna 52, if it is wireless or if the base is permanently installed, the connection to the security terminal may be wired. However, a wired connection is subject to being cut, so that some fail safe condition would be necessary to indicate an alarm condition if the wire is cut.

Whether wired or wireless, the alarm signal from the base is directed to the security station system 51. This system is under the control of microprocessor 53, which operates a program stored in memory 55. System 51, processor 53 and memory 55 may be part of a general security system adapted to incorporate features of the present invention. If an alarm signal is received, lights 56 and sound generator 54 may be operated to alert security personnel. If during the distribution of devices to patrons, information is entered through a keyboard 59 about the identity of the device, the table or wall where it will be located and any description of articles to be protected, this information may be processed by processor 53 and stored in a database that may be part of memory 55. If the alarm signal generated by base 10 includes its identification, the microprocessor can automatically look up the stored information and display it on display 58. Thus the security personnel will not only be notified that a theft is in progress, but the location where it is occurring and the item that is being taken. With this information, someone physically capable of apprehending the thief, and trained to do so, will be immediately dispatched to the area of the crime. In a more sophisticated system, security cameras can be located throughout the premises and can be automatically trained on the location of the theft by the security system.

While there have been shown, described, and pointed out fundamental novel features of the invention as applied to preferred embodiments thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A personal article anti-theft system comprising:

a base retained on a surface;

a hook connected to the base so that it can hang downward;

a detection circuit-within the base-and connected to the hook for detecting the presence of an item on the hook;

an alarm circuit operatively connected to the detection circuit for determining the removal of an item from the hook when the alarm circuit is in a set condition, and generating an alarm signal in response thereto; and a remote alarm detection circuit receiving the alarm signal at a distance from the base and producing a humanly perceivable indication of the alarm wherein the remote alarm detection circuit is further characterized as a remote security terminal, said terminal comprising:

a connection with said alarm circuit;

a processor for controlling the operation of the terminal;

an input device for inputting information about the intended location of the base in an establishment and an article to be protected at the base;

a memory for storing the information input by the input device;

an alarm for receiving an alarm signal from said base and providing a perceivable indication of the alarm at the remote security terminal; and a display under the control of the processor, said display displaying information about the location of the base which generated the alarm and the article at that base which was to be protected.

2. The personal article anti-theft system of claim 1 where in the base is retained on a table top near its edge so that the hook hangs over the edge.

3. The personal article anti-theft system of claim 1 where in the base is retained on a wall so that the hook hangs down along the surface of the wall.

4. The personal article anti-theft system of claim 2 where in the base is retained on the table top by at least one of its weight, clamps, suction cups, Velcro or fasteners.

5. The personal article anti-theft system of claim 3 where in the base is retained on the wall by at least one of clamps, suction cups, Velcro or fasteners.

6. The personal article anti-theft system of claim 1 where the detection circuit includes a strain gauge.

7. The personal article anti-theft system of claim 1 where the alarm signal is communicated to the remote detection circuit wirelessly.

8. The personal article anti-theft system of claim 7 where the wireless communication is by radio frequency signal.

9. The personal article-anti-theft system of claim 8 where the range of the radio frequency communication is up to at least 50 to 100 yards.

10. The personal article anti-theft system of claim 1 further including a key pad on the base for introducing a signal into the alarm circuit to put it into a set condition or to take it out of a set condition.

11. The personal article anti-theft system of claim 1 wherein remote alarm detection circuit is a portable pocket sized device in wireless communication with said alarm circuit, said pocket-sized device having at least one of a light, sound or vibration element to provide the humanly perceivable indication of the alarm.

12. The personal article anti-theft system of claim 1 wherein remote alarm detection circuit is in the form of a piece of jewelry wearable on the users garment, said alarm detection circuit being in wireless communication with said alarm circuit and having at least one of a light, sound or vibration element to provide the humanly perceivable indication of the alarm.

13. The personal article anti-theft system of claim 1 further including a pocket-sized portable remote device with an alarm detection circuit, and at least one of a light, sound or vibration element to provide the perceivable indication of the alarm simultaneously with the display of the information.

14. The personal article anti-theft system of claim 1 further including a piece of jewelry to be worn by a user with an alarm detection circuit, and at least one of a light, sound or vibration element to provide the perceivable indication of the alarm simultaneously with the display of the information.

* * * * *